US005868394A

United States Patent [19]

Garland et al.

[11] Patent Number: 5,868,394

[45] Date of Patent: Feb. 9, 1999

[54] TARGET ARRANGEMENT

[75] Inventors: Peter Garland, Manchester, Great Britain; Peter-Paul Theissen, Haan; Gerhard Lechner, Leverkusen, both of Germany

[73] Assignee: TTS Theissen Training Systems GmbH, Dusseldorf, Germany

[21] Appl. No.: 928,020

[22] Filed: Sep. 11, 1997

Related U.S. Application Data

[63] Continuation of Ser. No. 610,143, Feb. 29, 1996, abandoned.

[30] Foreign Application Priority Data

Jan. 16, 1996 [DE] Germany ..... 196 01 382.8

[51] Int. Cl.[6] ..... F41J 7/04

[52] U.S. Cl. ..... 273/386

[58] Field of Search ..... 273/386, 407, 273/408

[56] References Cited

U.S. PATENT DOCUMENTS

| | | | |
|---|---|---|---|
| 4,119,317 | 10/1978 | Ohlund et al. | 273/406 |
| 4,330,129 | 5/1982 | Meredith | 273/406 |
| 4,482,156 | 11/1984 | Karlsson | 273/406 |
| 5,067,683 | 11/1991 | Wagner | 273/407 |

FOREIGN PATENT DOCUMENTS

| | | | |
|---|---|---|---|
| 85294 | 3/1958 | Denmark | 273/406 |
| 27 06 961 | 8/1977 | Germany . | |
| 3532983 | 3/1987 | Germany | 273/391 |
| 2079164 | 1/1982 | United Kingdom | 273/407 |

OTHER PUBLICATIONS

MEDE '80, Erfolg und Protest, Internationale Wehrrevue Sep. 1980, p. 1463.

"Dixi", advertisement, 1984.

*Primary Examiner*—William H. Grieb

*Attorney, Agent, or Firm*—Steven F. Caserza; Flehr Hohbach Test Albritton & Herbert LLP

[57] ABSTRACT

The invention relates to a target arrangement having an essentially rectangular carrier frame for receiving a control unit and at least one drive for at least one target. In this arrangement, the carrier frame bears a rollover bar, which is connected releasably to the latter, the rollover bar having two bar parts, which are spaced apart by transverse struts, and being connected realeasably to the carrier frame, at least on that side of the latter which is remote from the target, via a plugin connection, with the result that the rollover bar can be plugged onto the carrier frame in order to extend the carrier frame.

24 Claims, 2 Drawing Sheets

TARGET ARRANGEMENT

CROSS REFERENCE TO RELATED APPLICATIONS

This application is a continuation of U.S. application Ser. No. 08/610,143, (abandoned ) filed Feb. 29, 1996, which is related to copending U.S. patent application Ser. No. 08/610,144 (Attorney Docket Number A-63037) entitled "TARGET ARRANGEMENT", and Ser. No. 08/610,142 (Attorney Docket Number A-63039) entitled "MOVABLE TARGET FOR SHOOTING PRACTICE".

BACKGROUND OF THE INVENTION

The invention relates to a target arrangement.

Target arrangements which comprise a carrier frame which receives a drive, arranged in a drive housing, and a control unit arranged in a control housing, allowing a target borne by a target-retainer to be pivoted in a manner controlled by the control unit, by means of the drive, out of a neutral position into a target position, are known. Target arrangements of this type are generally relatively large and heavy, in order to have a corresponding stability for positioning on outdoor terrain, and are frequently subjected to harsh treatment when being unloaded from transporting vehicles, as a result of which damage can be caused.

SUMMARY

The object of the invention is to provide a target arrangement, which, while simultaneously protecting against damage, makes it possible to manage with a smaller base surface area and lower weight.

A target arrangement includes a carrier frame with a rollover bar, which is connected releasably to the latter, and serves to protect drive(s) and a control unit for the target(s). The rollover bar has two bar parts, which are spaced apart by transverse struts and each having two feet, and is connected releasably to the carrier frame, at least on that side of the carrier frame which is remote from the target, via a plug-in connection for the feet and/or transverse struts which, together with mating pieces on the carrier frame, form releasable plug-in connections. The rollover bar, once it has been released, can be rotated through 180° in the horizontal plane or displaced by the length of the rollover bar, and positioned on the rollover bar again, in order to extend the carrier frame, as a result of which the standing surface is considerably increased. This makes it possible to reduce the weight of the target arrangement correspondingly, since the stability is ensured by a large standing surface.

BRIEF DESCRIPTION OF THE DRAWINGS

The invention is explained in more detail hereinbelow with reference to exemplary embodiments represented in the accompanying drawings, in which.

DETAILED DESCRIPTION

Figure 1:
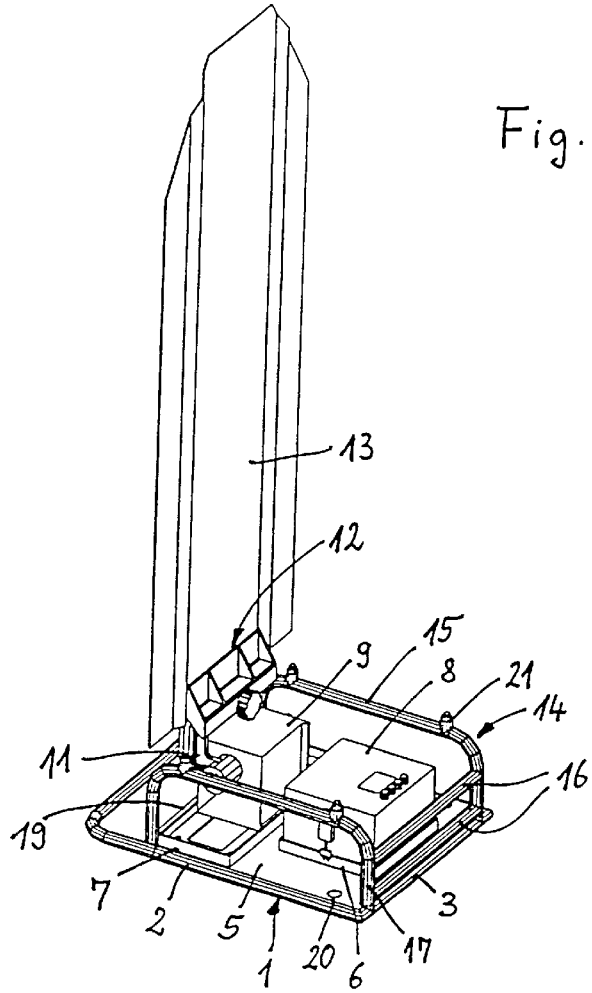
FIGS. 1 and 2 show, in perspective, target arrangements according to the present invention.
Figure 3:
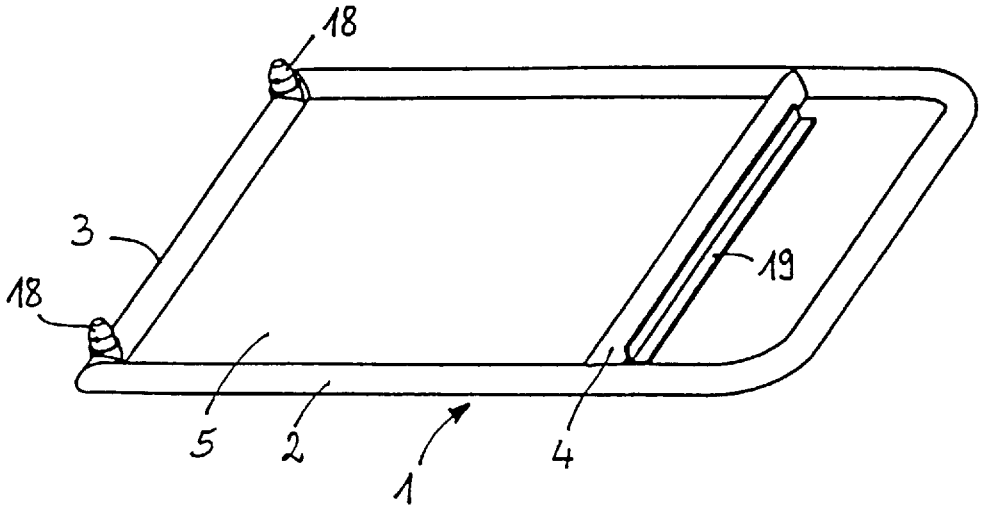
FIG. 3 shows, in perspective, one embodiment of a carrier frame suitable for use with the target arrangements of FIGS. 1 and 2.
Figure 4:
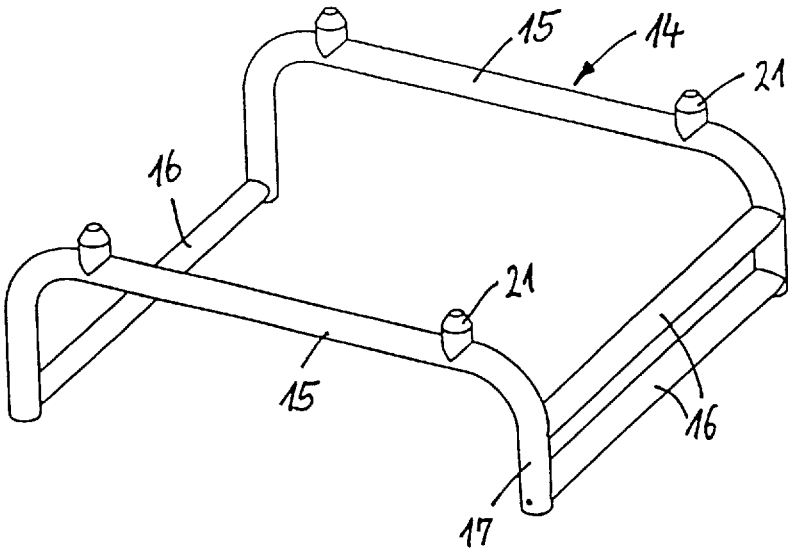
FIG. 4 shows, in perspective, one embodiment of a rollover bar suitable for use with the target arrangements of FIGS. 1 and 2.

The target arrangement depicted in FIG. 1 comprises a carrier frame 1 which is designed in an approximately rectangular manner, in the form of a tube structure. The latter comprises, in the exemplary embodiment shown (see also FIG. 3), a U-shaped tube bar 2, with a connecting strut 3 at the end of the tube bar 2, as well as a transverse strut 4, parallel to said connecting strut 3, at a distance from the central leg of the tube bar 2. The carrier frame 1 further has a base 5 which is arranged in the region between the connecting strut 3 and the transverse strut 4 and comprises, for example, two base plates which are fastened on the tube bar 2 at the top and bottom and may possibly receive reinforcement profiles between them.

Two receiving frames 6, 7 for a control unit 8 and not more than two drives 9 are fastened on the base 5. The drive 9 has a laterally projecting shaft 10 on which there is seated, in the exemplary embodiments shown in FIGS. 1 and 2, an angled arm 11 which bears a target-retainer 12 for a target 13. The drive 9, along with the arm 11 and the target-retainer 12, thus form a pivot device for a target 13, which device makes it possible for a target 13 to be pivoted between a horizontal position and a vertical position.

By virtue of corresponding rotation of the drive 9, with the result that the shaft 10 projects upwards, and by using a different connecting piece, instead of the arm 11, between the shaft 10 and target-retainer 12, it is also possible for the target 13 to be rotated about a vertical axis between a neutral position and a target position.

A protective frame or rollover bar 14 is fastened on the carrier frame 1. The rollover bar 14 is likewise designed as a tube structure, and comprises two U-shaped guide rails or frame members 15 which are connected to one another by transverse struts 16. The frame members 15 each include two feet 17 which are open towards the bottom. In one embodiment, the rollover bar 14 is narrower than the carrier frame 1 by somewhat more than double the thickness of the tube of said carrier frame 1.

Two connectors or stubs 18 are fastened on the connecting strut 3 of the carrier frame 1 such that they are spaced apart by the distance between the feet 17 of the rollover bar 14, with the result that the rollover bar 14 can be plugged onto the stubs 18 by means of its feet 17 and can be secured there by means of securing pins (not shown) plugged through the respective foot 17 and the stub 18, received by the latter.

The other two feet 17 of the rollover bar 14 are longer, by the tube thickness of the struts 3, 4, than the feet which receive the stubs 18. Moreover, the width of the rollover bar 14 is such that it fits between the parallel legs of the tube bar 2. An L-shaped member 19 is fastened on that side of the transverse strut 4 which is remote from the connecting strut 3, the L-shaped member having a lower horizontal leg or flange which serves as standing surface or stop surface for those feet 17 of the rollover bar 14 which are situated there and for that transverse strut 16 of the rollover bar 14 which is located there. In particular, the rollover bar 14 is in clamping-type engagement with the L-shaped member 19.

Figure 2:
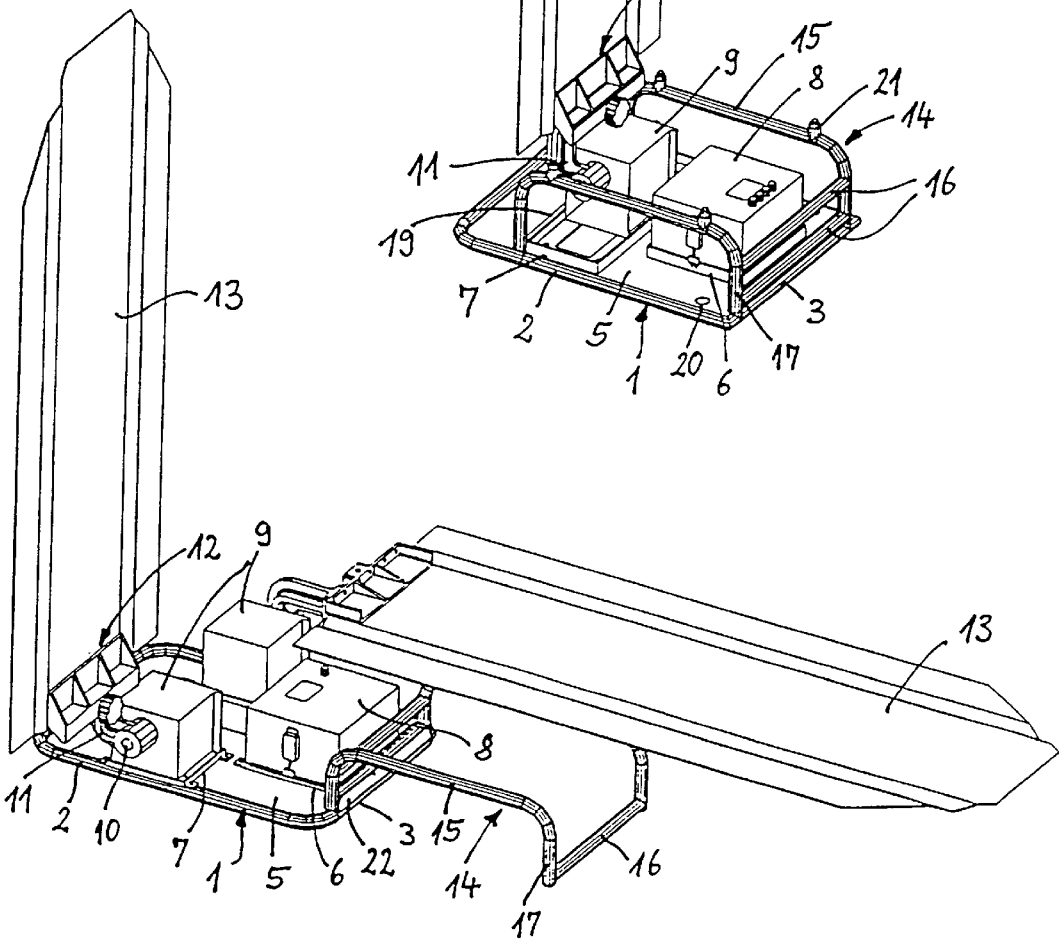

By virtue of the securing pins being released, the rollover bar 14 can be easily removed from the carrier frame 1 and, when it is rotated through 180° in the horizontal plane, it can be plugged onto the stubs 18 again, by means of the shorter feet 17, and secured, with the result that the standing surface of the target arrangement is correspondingly increased (see also FIG. 2 in this connection).

Of course, it is also possible for the longer feet 17 to be plugged onto the stubs 18, for example if corresponding unevennesses in the terrain are to be compensated for.

The base 5 has four holes 20 for receiving stubs 21 fastened on the upper side of the rollover bar 14, in order for it to be possible to stack a plurality of target arrangements (without targets 13), which each comprise a carrier frame 1, a rollover bar 14, a control unit 8 and one or two drives 9, i.e. without arm(s) 11 and without target-retainer 12 and target(s) 13, one on top of the other, for example for transportation purposes, without the risk of them slipping.

In an alternative embodiment, a C-profile is provided instead of the L-shaped member 19, which an elongate connecting member having a C-shaped cross section is open towards the central leg of the tube bar 2 and serves to receive that transverse strut 16 of the rollover bar 14 which is arranged between the ends of the longer feet 17.

Instead of the L-shaped member 19, the transverse strut 4 may, if desired, likewise bear stubs 18, with the result that all four feet 17 of the rollover bar 14 receive a stub 18 when the rollover bar 14 is used as such and not in order to extend the carrier frame 1 (see FIG. 1).

FIG. 2 shows a target arrangement which, unlike FIG. 1, bears two drives 9 for the independent pivoting of two targets 13. The carrier frame 1 has corners which are rounded overall, i.e. rounded corners are also present at the ends of the connecting strut 3.

Provided on the connecting strut 3 is a an elongate connecting member having a C-shaped cross section 22 which is open towards the top and is intended for the plug-in attachment, if desired in a clamping manner, of a transverse strut 16 located between the ends of two feet 17 of the two frame members 15, it being possible for said transverse strut to be secured on the carrier frame 1, if desired, for example by securing pins.

Adjacent to the targets 13, in this case, an L-shaped member 19 or a further C-shaped connecting member or a pair of stubs 18, as in the exemplary embodiment of FIG. 1, may be provided on the carrier frame 1, for example on the transverse strut 4 thereof.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. A target support assembly comprising:

a carrier frame for supporting a control unit and at least one drive assembly;

a rollover bar mounted to said carrier frame in a selected one of two positions, said rollover bar upstanding from said carrier frame for protecting the control unit and the at least one drive assembly in a first position and said rollover bar extending outwardly from said carrier frame in a second position, the rollover bar comprising two spaced apart frame members shaped to define guard rails spaced above said carrier frame when said rollover bar is in the first position and transverse struts extending between and mounted to said frame members; and at least one connector carried by said carrier frame for securing said rollover bar in the first position with said rollover bar extending upwardly from said carrier frame and in the second position with said rollover bar extending outwardly from said carrier frame.

2. A target support assembly according to claim 1, wherein two connectors are carried by said carrier frame and said rollover bar includes feet shaped to mate with said connectors to secure said rollover bar in each of the first and second positions.

3. A target support assembly according to claim 1, and further comprising a control unit and at least one drive assembly carried by said carrier frame, said drive assembly retaining and moving at least one target.

4. A target support assembly according to claim 2, wherein said connectors are provided by two stubs mounted to said carrier frame, said stubs being positioned to engage said feet of the rollover bar, said feet each having an inward extending bore shaped to receive one of said stubs.

5. A target support assembly according to claim 1, wherein said connector engages one end of said rollover bar and the carrier frame includes a securing device spaced from said connector for engaging the other end of said rollover bar to secure said rollover bar in the first position extending upwardly from said carrier frame.

6. A target support assembly according to claim 5, wherein said securing device is provided by a clamping device.

7. A target support assembly according to claim 5, wherein each of said frame members of said rollover bar includes spaced feet, and wherein said securing device includes a horizontal flange which supports one foot of each frame member of the rollover bar.

8. A target support assembly according to claim 7, wherein said carrier frame includes two of said connectors, the other foot of each of said frame members engaging one of said connectors to secure said rollover bar in the first position, the feet engaging said connectors being shorter than the feet supported by said horizontal flange by the thickness of the carrier frame.

9. A target support assembly according to claim 5 wherein said securing device is provided by an elongate member having a C-shaped cross section, said elongate member being shaped to receive one of said transverse struts of said rollover bar to secure said rollover bar in the first position.

10. A target support assembly according to claim 5 wherein said securing device is provided by a stub-type connector.

11. A target support assembly according to claim 5 wherein said carrier frame includes at least one transverse member parallel to said transverse struts of said rollover bar when said rollover bar is in the first position, said securing device being carried by said transverse member of the carrier frame.

12. A target support assembly according to claim 1 wherein said carrier frame includes a base plate having a plurality of holes formed therein and arranged in a predetermined pattern, the rollover bar having stubs formed on the upper side of the rollover bar which engage the holes formed in the base plate when a plurality of said target support assemblies are arranged in a stacked configuration.

13. A target support assembly according to claim 1 wherein said carrier frame and the rollover bar comprise tubular structural members.

14. A target support assembly according to claim 1 wherein said connector is provided by an elongate member having a C-shaped cross section, said elongate member being shaped to receive one of said transverse struts of said rollover bar to secure said rollover bar in the first position and in the second position.

15. A target support assembly comprising:

a carrier frame having an upper surface for supporting a drive assembly having at least one target holder for holding a target and at least one drive mechanism for moving the at least one target holder relative to the carrier frame, a lower surface positionable on the terrain and a peripheral edge; and a detachable protective frame including spaced guard rails and transverse members interconnecting said guard rails, said protective frame being releasably mounted to said carrier frame in a selected one of a first position, with said protective frame upstanding from the upper surface of said carrier frame and said guard rails positioned on opposite sides of said drive assembly for protecting said drive assembly, and a second position, with said protective frame extending outwardly from the peripheral edge of said carrier frame.

16. The target support assembly according to claim 15, and further comprising a drive assembly carried by said carrier frame and projecting upwardly from said upper surface of said carrier frame, said drive assembly including at least one target holder for holding a target and at least one drive mechanism for moving said at least one target holder relative to said carrier frame.

17. The target support assembly of claim 15 wherein said carrier frame includes first and second connectors, each of said connectors mating with one of said guard rails to secure said protective frame in a selected one of said first position and said second position.

18. The target support assembly of claim 17 wherein said guard rails each include a first end shaped to releasably engage one of said connectors and a second end spaced from said first end, said second end of each guard rail engaging said carrier frame when said protective frame is in said first position extending upwardly from said carrier frame.

19. The target support assembly of claim 18 wherein said carrier frame includes first and second side rails and at least one transverse member extending between said side rails, said transverse member including a horizontal flange for supporting said second ends of said guard rails when said protective frame is in said first position.

20. The target support assembly of claim 17 wherein said carrier frame includes an elongate connector spaced from said first and second connectors, said elongate connector engaging one of said transverse members of said protective frame when said protective frame is in said first position.

21. A target support assembly comprising:

a carrier frame for supporting a control unit and at least one drive assembly;

a rollover bar mounted to said carrier frame in a selected one of two positions, said rollover bar extending upwardly from said carrier frame for protecting the control unit and the at least one drive assembly in a first position and said rollover bar extending outwardly from said carrier frame in a second position, the rollover bar comprising two spaced apart frame members shaped to define guard rails spaced above said carrier frame when said rollover bar is in the first position and transverse struts extending between and mounted to said frame members;

at least one connector carried by said carrier frame for securing said rollover bar in the first position with said rollover bar extending upwardly from said carrier frame and in the second position with said rollover bar extending outwardly from said carrier frame;

said connector engaging one end of said rollover bar and the carrier frame includes a securing device spaced from said connector, said securing device clamping the other end of said rollover bar to said carrier framer to secure said rollover bar in the first position extending upwardly from said carrier frame.

22. A target support assembly according to claim 21 wherein said securing device is provided by an elongate member having a C-shaped cross section, said elongate member being shaped to receive one of said transverse struts of said rollover bar to secure said rollover bar in the first position.

23. A target support assembly comprising:

a carrier frame for supporting a control unit and at least one drive assembly;

a rollover bar mounted to said carrier frame in a selected one of two positions, said rollover bar extending upwardly from said carrier frame for protecting the control unit and the at least one drive assembly in a first position and said rollover bar extending outwardly from said carrier frame in a second position, the rollover bar comprising two spaced apart frame members shaped to define guard rails spaced above said carrier frame when said rollover bar is in the first position and transverse struts extending between and mounted to said frame members, said frame members each having first and second feet;

at least one connector carried by said carrier frame for securing said rollover bar in the first position with said rollover bar extending upwardly from said carrier frame and in the second position with said rollover bar extending outwardly from said carrier frame;

said connector engaging one end of said rollover bar and the carrier frame includes a horizontal flange spaced from said connector, said horizontal flange supporting one of said feet of each of said frame members of said rollover bar to retain said rollover bar in the first position extending upwardly from said carrier frame.

24. A target support assembly comprising:

a carrier frame having an upper surface, a lower surface positionable on the terrain and a peripheral edge;

a drive assembly carried by said carrier frame and projecting upwardly from said upper surface of said carrier frame, said drive assembly including at least one target holder for holding a target and at least one drive mechanism for moving said at least one target holder relative to said carrier frame; and a detachable protective frame including spaced guard rails and transverse members interconnecting said guard rails, said protective frame being releasably mounted to said carrier frame in a selected one of a first position, with said protective frame extending upwardly from the upper surface of said carrier frame and said guard rails positioned on opposite sides of said drive assembly for protecting said drive assembly, and a second position, with said protective frame extending outwardly from the peripheral edge of said carrier frame;

said carrier frame including an elongate connector spaced from said first and second connectors, said elongate connector engaging one of said transverse members of said protective frame when said protective frame is in said first position.

* * * * *